US007301089B1

(12) United States Patent
Liao

(10) Patent No.: US 7,301,089 B1
(45) Date of Patent: Nov. 27, 2007

(54) STRING TUNING ADJUSTER

(76) Inventor: Kuang-Yi Liao, No. 63, Ann Lin 2nd St., Yan Chao Shiang, Kaohsiung Hsien (TW)

( * ) Notice: Subject to any disclaimer, the term of this patent is extended or adjusted under 35 U.S.C. 154(b) by 0 days.

(21) Appl. No.: 11/464,462

(22) Filed: Aug. 14, 2006

(51) Int. Cl.
*G10G 3/00* (2006.01)

(52) U.S. Cl. ..... 84/453

(58) Field of Classification Search ..... 84/453, 84/458

See application file for complete search history.

(56) References Cited

U.S. PATENT DOCUMENTS 6,294,719 B1 * 9/2001 Palecki et al. ..... 84/458

* cited by examiner

*Primary Examiner*—Kimberly Lockett
(74) *Attorney, Agent, or Firm*—WPAT, PC

(57) ABSTRACT

A string tuning adjuster is a stick including a first aperture, a second aperture and a third aperture. Each aperture has a different diameter with respect to the others. The first aperture is disposed at a center section of the stick, while the second and the third apertures are disposed at opposite ends of the stick. The first aperture or the second aperture is inserted onto a string peg of a cello or a viola, respectively. The third aperture is inserted onto a string peg of a violin to facilitate tune adjustment.

3 Claims, 5 Drawing Sheets

STRING TUNING ADJUSTER

BACKGROUND OF THE INVENTION

1. Field of the Invention

The present invention relates to a string tuning adjuster, in particular to an adjuster which enables to fit onto a string peg of a cello, a viola or a violin to do fine tune adjustment.

2. Description of the Prior Art

Strings on a cello, a viola or a violin tend to be loose after a period of time. It is needful to do tune adjustment. The adjustment can be done by turning a string peg to tighten or loose the string.

However, the string peg is small in size, which is hard to hold and to turn by hand, it may even hurt fingers in some cases.

SUMMARY OF THE INVENTION

It is the primary objective of the present invention to provide a string tuning adjuster, which is easy to do tune adjustment.

It is another objective of the present invention to provide a string tuning adjuster, which is designed to fit all string instruments.

According to the present invention, there is provided a string tuning adjuster comprising a stick having a first aperture at a center section thereof, a second aperture and a third aperture at opposite ends thereof, each of said apertures having a different diameter.

DETAILED DESCRIPTION OF THE PREFERRED EMBODIMENT

Figure 1:
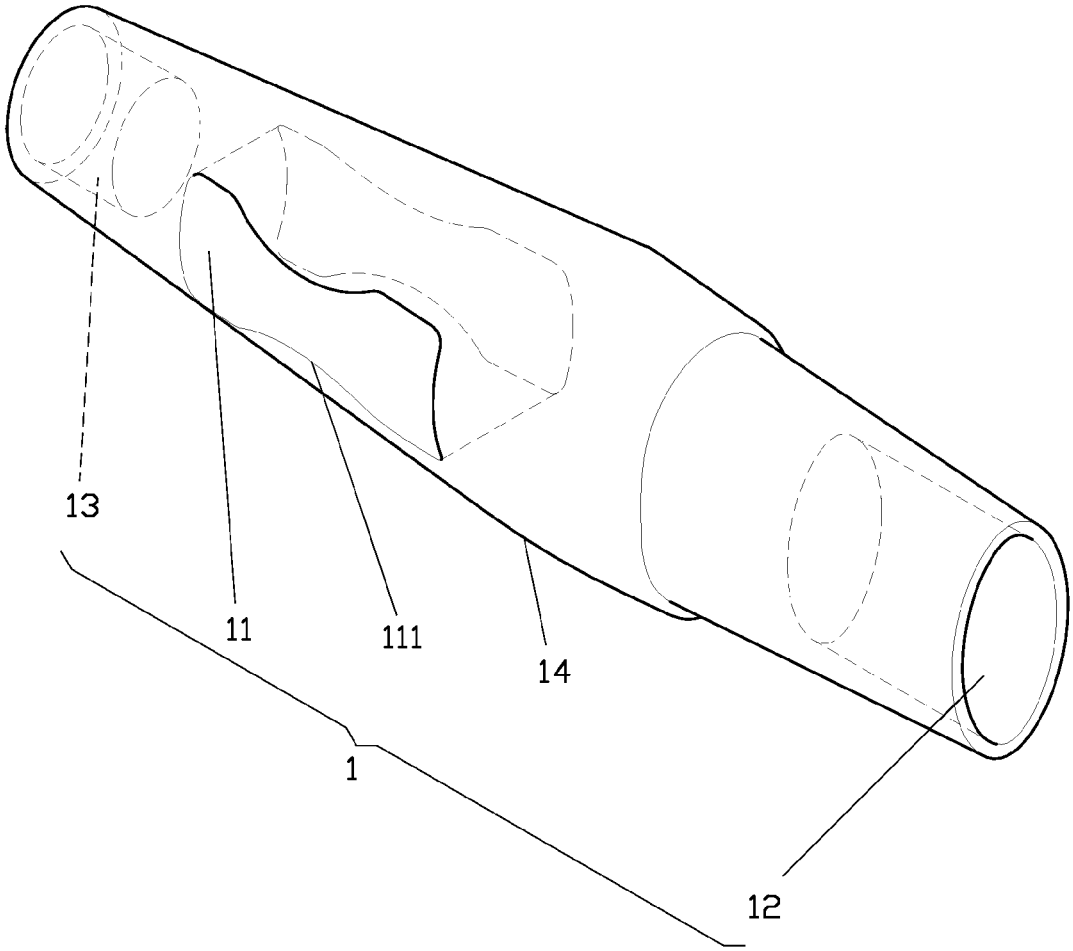
FIG. 1 is a perspective view of a first embodiment of the present invention.

A string tuning adjuster of a first embodiment of the present invention, as shown in FIG. 1, is a stick 1. The stick 1 comprises a first aperture 11, a second aperture 12 and a third aperture 13. Each aperture has a different diameter with respect to the others. The first aperture 11 is disposed at a center section of the stick 1, while the second and the third apertures 12 and 13 are disposed at opposite ends of the stick 1. The first aperture 11 is in a strip shape and formed with a pair of curved blocks 111 at inner center portion corresponding with each other. The stick 1 further comprises a grasp section 14 at the center section of the stick 1.

Figure 2:
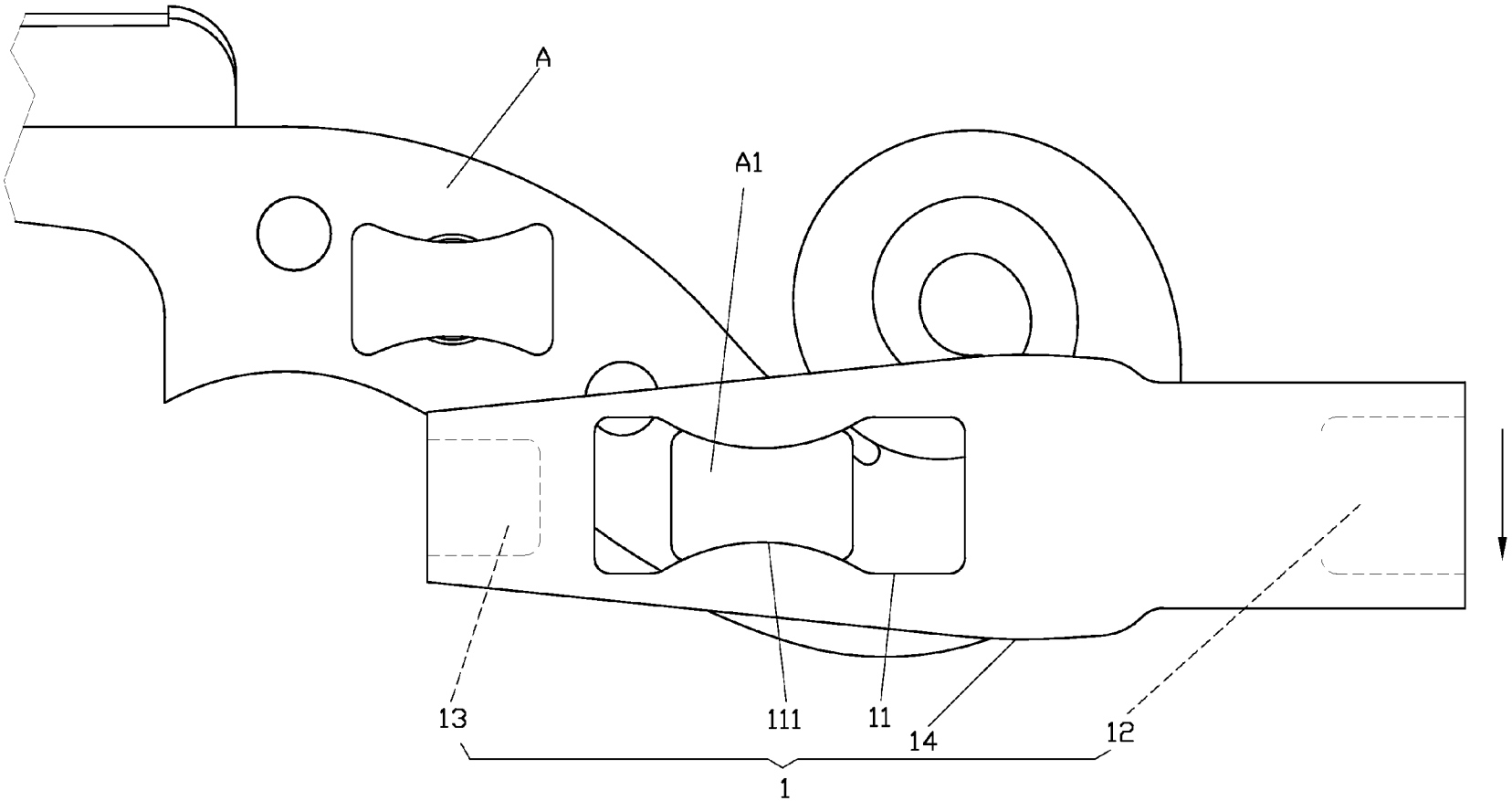
FIG. 2 is a side view of the first embodiment of the present invention applied to a cello or a viola.

When the present invention is used to realign a string peg A1 of a cello or a viola A, the first aperture 11 of the stick 1 is inserted onto the string peg A1, with the blocks 111 of the first aperture 11 engaging with two sides of the string peg A1 to confine its movement. The user holds the grasp section 14 to turn the stick 1, as shown in FIG. 2, so as to tighten or loosen the string peg A1.

Likewise, the second aperture 12 at one end of the stick 1 is inserted onto a string peg A1 of a cello or a viola A. The user holds the grasp section 14 to turn the stick 1 so as to tighten or loosen the string peg A1.

Figure 3:
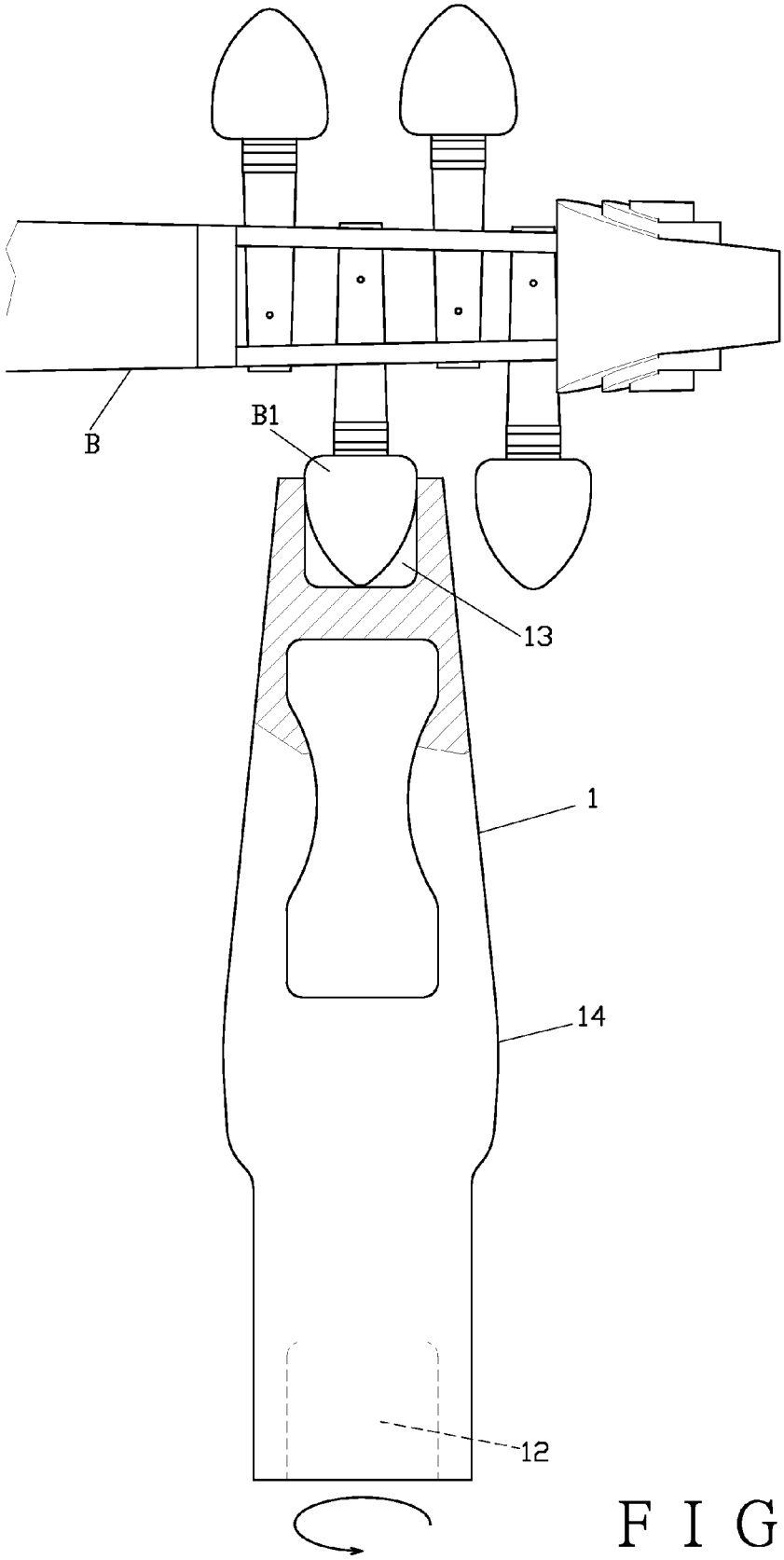
FIG. 3 is a side view of the first embodiment of the present invention applied to a violin.

To adjust a violin B with the present invention, as shown in FIG. 3, the third aperture 13 is inserted onto a string peg B1 of the violin B. The user holds the grasp section 14 of the stick 1 to tighten or loosen the string peg B1.

Figure 4:
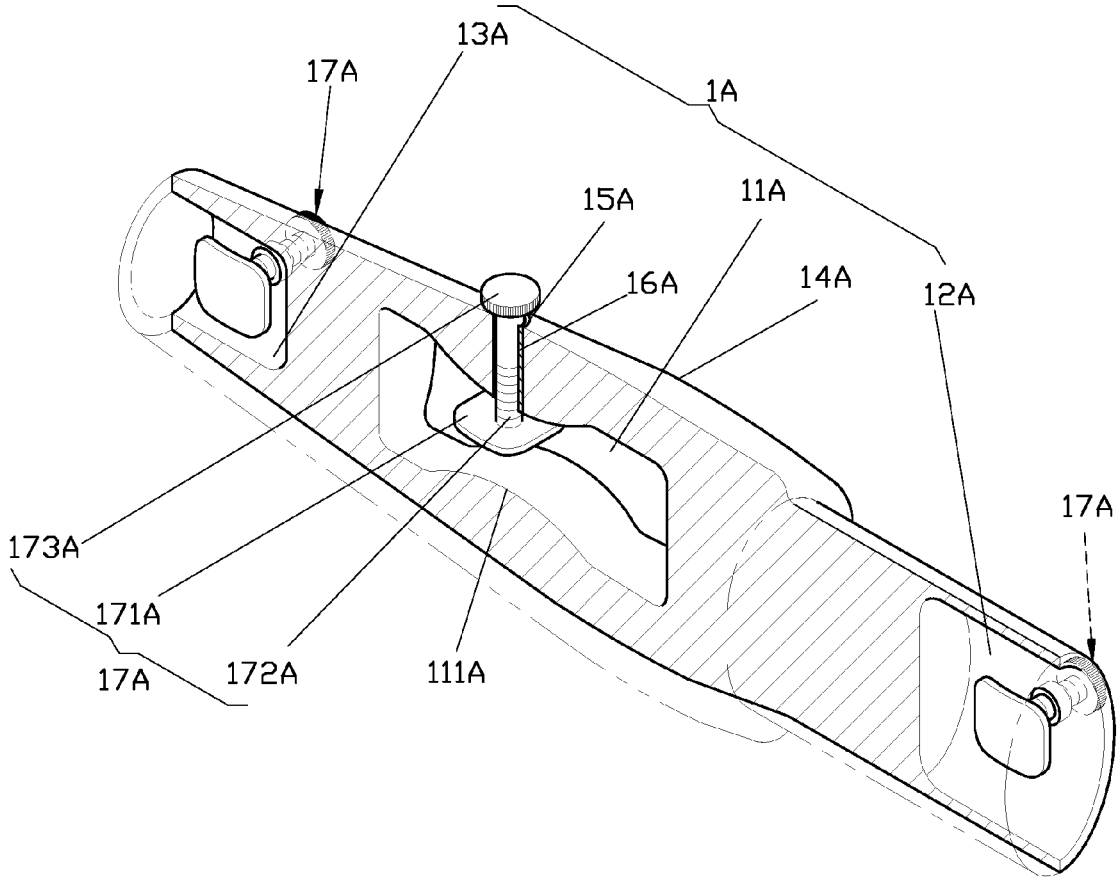
FIG. 4 is a cross sectional view of a second embodiment of the present invention.

As shown in FIG. 4, a second embodiment of the present invention is a stick 1A. The stick 1A comprises a first aperture 11A, a second aperture 12A and a third aperture 13A. Each aperture has a different diameter with respect to the others. The first aperture 11A is disposed at a center section of the stick 1A, while the second and the third apertures 12A and 13A are disposed at opposite ends of the stick 1A. The first aperture 11A is in a strip shape and formed with a pair of cured blocks 111A at inner center portion corresponding with each other. The stick 1A further comprises a grasp section 14A at the center section of the stick 1A. The stick 1A further comprises at least a through hole 15A which interconnects with the first aperture 11A, the second aperture 12A, and the third aperture 13A, respectively. The through hole 15A is provided with a fastener 16A which is a sleeve having female threads therein. A locating device 17A comprises a washer 171A, a bolt 172A and a cap 173A. The bolt 172A is disposed on the washer 171A, screwed into the fastener 16A and secured by the cap 173A. Both the second aperture 12A and the third aperture 13A are provided with locating devices 17A, respectively.

Figure 5:
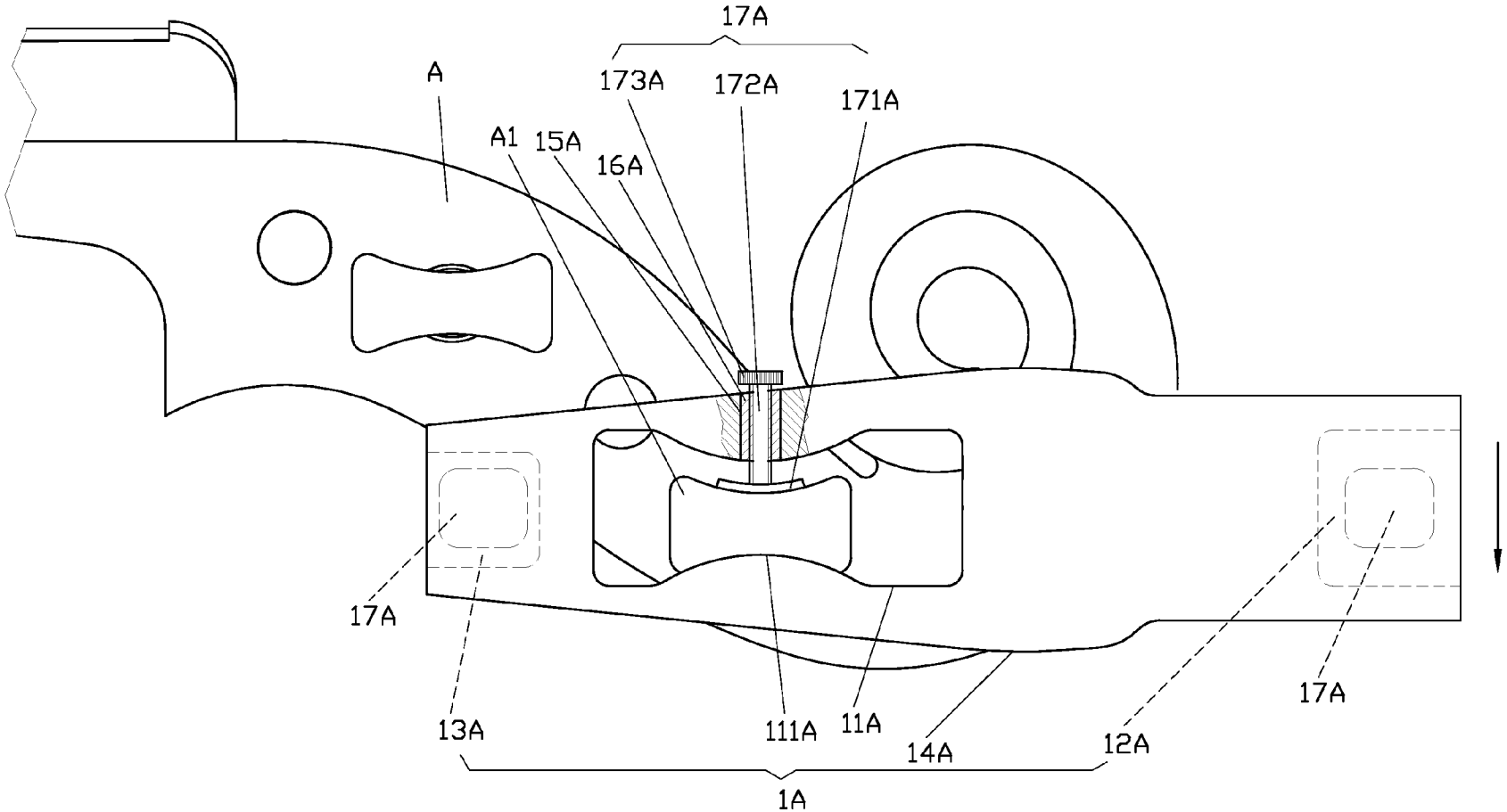
FIG. 5 is a side view of the second embodiment of the present invention applied to a cello or a viola.

To operate the second embodiment of the present invention, as shown in FIG. 5, the first aperture 11A of the stick 1A is inserted onto the string peg A1 of either the cello or the viola A, the string peg A1 has an outer diameter smaller than the space between the two blocks 111A of the first aperture 11A. When the cap 173A of the locating device 17A is turned, the bolt 172A will descend downward along the fastener 16A in the through hole 15A, so that the washer 171A is linked to engage with one end of the string peg A1. The user simply holds the grasp section 14A and turns the stick 1A to tighten or to loose the string peg A1 to tune the string. The operation of the locating device 17A in either the second aperture 12A or the third aperture 13A is same as that of the locating device 17A in the first aperture 11A.

What is claimed is:

1. A string tuning adjuster comprising a stick, said stick comprising a first aperture at a center section thereof, a second aperture and a third aperture at opposite ends thereof, each of said apertures having a different diameter, wherein the first aperture of said stick is in a strip shape and is formed with a pair of curved blocks at inner center portion thereof;

wherein said stick comprises a grasp section at the center section thereof; and wherein said stick comprises at least one through hole interconnecting with said first aperture, said second aperture and said third aperture, respectively, said through hole being provided with a fastener to connect with a locating device, said locating device comprising a washer and a bolt.

2. The string tuning adjuster, as recited in claim 1, wherein said fastener is a sleeve having female threads therein.

3. The string tuning adjuster, as recited in claim 1, wherein a cap is provided on said bolt.

* * * * *